US012497967B2

(12) United States Patent
Cho et al.

(10) Patent No.: US 12,497,967 B2
(45) Date of Patent: Dec. 16, 2025

(54) HORIZONTAL COMPRESSOR

(71) Applicant: SAMSUNG ELECTRONICS CO., LTD., Suwon-si (KR)

(72) Inventors: Yanghee Cho, Suwon-si (KR); Joonhyung Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 284 days.

(21) Appl. No.: 17/966,263

(22) Filed: Oct. 14, 2022

(65) Prior Publication Data

US 2023/0094593 A1 Mar. 30, 2023

Related U.S. Application Data

(63) Continuation of application No. PCT/KR2022/008695, filed on Jun. 20, 2022.

(30) Foreign Application Priority Data

Sep. 29, 2021 (KR) ..... 10-2021-0129262

(51) Int. Cl.
*F04C 29/12* (2006.01)
*F04C 29/02* (2006.01)

(52) U.S. Cl.
CPC ..... *F04C 29/12* (2013.01); *F04C 29/026* (2013.01); *F04C 2230/231* (2013.01);
(Continued)

(58) Field of Classification Search
CPC .... F04C 29/12; F04C 29/026; F04C 2230/23; F04C 2230/231; F04C 2240/30; F04C 2240/40; F04C 2240/806
See application file for complete search history.

(56) References Cited

U.S. PATENT DOCUMENTS 2,316,016 A * 4/1943 Packie ..... B01D 45/08 55/459.1
5,435,700 A * 7/1995 Park ..... F04B 39/123 181/403

(Continued)

FOREIGN PATENT DOCUMENTS

JP 2568711 B2 * 9/1991 ..... F04C 18/04
JP 2568711 1/1997

(Continued)

OTHER PUBLICATIONS

JP2568711B_MT, Machine Translation of JP-2568711-B2 (Year: 1991).*

(Continued)

*Primary Examiner* — Michael J Tsai
*Assistant Examiner* — Charles W Nichols
(74) *Attorney, Agent, or Firm* — STAAS & HALSEY LLP

(57) ABSTRACT

A horizontal compressor includes a case; a high and low pressure separating plate dividing an inner space of the case into a high-pressure chamber and a low-pressure chamber; a compressor in the high-pressure chamber configured to be operated by a motor to compress refrigerant; a suction pipe in the case to communicate with the low-pressure chamber and through which the refrigerant is sucked; and an internal suction pipe to pass through the high and low pressure separating plate, one end of the internal suction pipe connected to the compressor and another end of the internal suction pipe to communicate with the low-pressure chamber so that the refrigerant in the low-pressure chamber flows into the compressor, wherein the internal suction pipe includes a connecting pipe adjacent to a lower surface of the case parallel to a central axis of the case.

15 Claims, 13 Drawing Sheets

(52) U.S. Cl.
CPC ..... *F04C 2240/30* (2013.01); *F04C 2240/40* (2013.01); *F04C 2240/806* (2013.01)

(56) References Cited

U.S. PATENT DOCUMENTS

| | | | | |
|---|---|---|---|---|
| 5,887,444 | A * | 3/1999 | Toyoshima | F25B 43/006 62/503 |
| 6,213,732 | B1 * | 4/2001 | Fujio | F04C 29/068 181/403 |
| 9,022,757 | B2 | 5/2015 | Shin et al. | |
| 9,435,342 | B2 | 9/2016 | Kiem et al. | |
| 9,441,630 | B2 | 9/2016 | Kiem et al. | |
| 2010/0215533 | A1 * | 8/2010 | Kiyokawa | F04C 23/008 418/55.1 |

FOREIGN PATENT DOCUMENTS

| | | |
|---|---|---|
| JP | 2002-202059 | 7/2002 |
| JP | 2003-129960 | 5/2003 |
| JP | 2005-146987 | 6/2005 |
| JP | 2020-139695 | 9/2020 |
| KR | 10-1995-0010176 | 9/1995 |
| KR | 10-1996-0000984 | 1/1996 |
| KR | 10-0202618 | 6/1999 |
| KR | 10-0202619 | 6/1999 |
| KR | 10-0287447 | 4/2001 |
| KR | 10-0480134 | 4/2005 |
| KR | 10-0504913 | 7/2005 |
| KR | 10-0565223 | 3/2006 |
| KR | 10-0575836 | 5/2006 |
| KR | 10-0629870 | 9/2006 |
| KR | 10-1441928 | 9/2014 |
| KR | 10-1447038 | 10/2014 |
| KR | 10-1447039 | 10/2014 |
| KR | 10-1462940 | 11/2014 |
| KR | 10-1462941 | 11/2014 |
| KR | 10-1533251 | 7/2015 |
| KR | 10-1767063 | 8/2017 |

OTHER PUBLICATIONS

JP2005146987A_MT, Machine Translation of JP-2005146987-A (Year: 2005).*

International Search Report dated Oct. 7, 2022 in International Patent Application No. PCT/KR2022/008695 (3 pages; 3 pages English translation).

Written Opinion dated Oct. 7, 2022 in International Patent Application. No. PCT/KR2022/008695 (4 pages).

* cited by examiner

HORIZONTAL COMPRESSOR

CROSS-REFERENCE TO RELATED APPLICATION

This application is a continuation application, under 35 USC § 111(a), of PCT Application No. PCT/KR2022/008695, filed on Jun. 20, 2022 which claims the benefit of Korean Patent Application No. 10-2021-0129262, filed on Sep. 29, 2021 in the Korean Intellectual Property Office, the disclosures of which are incorporated by reference herein in their entirety.

BACKGROUND

1. Field

The disclosure relates to a horizontal compressor, and more particularly, to a horizontal compressor having a built-in accumulator.

2. Description of Related Art

Generally, in a compressor used in a refrigeration apparatus, an accumulator, which is a gas-liquid separator, is disposed to prevent excessive suction of oil and refrigerant in liquid state (hereinafter referred to as liquid refrigerant) into the compressor.

The compressor may be classified into a vertical compressor and a horizontal compressor according to the arrangement of a compression part for compressing the refrigerant and a motor part for driving the compression part. In the vertical compressor, the compression part and the motor part are vertically arranged. In the horizontal compressor, the compression part and the motor part are horizontally arranged.

Recently, the horizontal compressor has been used to expand the capacity of a case of a commercial refrigerator such as a showcase.

In general, the accumulator is formed separately from the horizontal compressor, and is disposed outside the horizontal compressor.

However, when the accumulator is disposed outside the horizontal compressor as described above, the installation area of the horizontal compressor including the accumulator increases, so there is a problem in that there is a limit in reducing the size of the commercial refrigerator.

Therefore, it is required to develop a horizontal compressor capable of reducing the installation area while including an accumulator.

The disclosure has been developed in order to overcome the above drawbacks and other problems associated with the conventional arrangement.

SUMMARY

According to an aspect of the disclosure, a horizontal compressor may include a case; a high and low pressure separating plate formed to divide an inner space of the case into a high-pressure chamber and a low-pressure chamber; a motor disposed in the high-pressure chamber; a compressor disposed in the high-pressure chamber and driven by the motor to compress refrigerant; a suction pipe disposed in the low-pressure chamber and through which the refrigerant is suctioned; and an internal suction pipe disposed to pass through the high and low pressure separating plate, one end of the internal suction pipe connected to the compressor in the high-pressure chamber and another end of the internal suction pipe disposed in the low-pressure chamber so that the refrigerant in the low-pressure chamber flows into the compressor through the internal suction pipe, wherein the internal suction pipe may include a connecting pipe disposed adjacent to a lower surface of the case parallel to a central axis of the case, the connecting pipe connected to the compressor, and passing through the high and low pressure separating plate; and a stand pipe formed to extend upward along a vertical axis of the horizontal compressor from one end of the connecting pipe and disposed in the low-pressure chamber.

An inlet of the stand pipe may be positioned higher than the suction pipe along the vertical axis.

An oil hole may be provided in a portion of the internal suction pipe adjacent to a lower portion of the low-pressure chamber.

A leading end portion of the suction pipe is formed bent and located in the low-pressure chamber so that an outlet of the leading end portion faces an inner circumferential surface of the case.

The outlet of the suction pipe may be located below a virtual straight line passing through a center of a straight portion of the suction pipe passing through the case.

The high and low pressure separating plate may be formed in a curved plate convexly protruding to one side.

The case may include a main case forming the high-pressure chamber; and a sub-case forming the low-pressure chamber, wherein the high and low pressure separating plate may be disposed between the main case and the sub-case.

The main case, the sub-case, and the high and low pressure separating plate may be coupled by welding.

The high and low pressure separating plate may be formed to protrude toward the sub-case.

The high and low pressure separating plate may include a curved portion formed as a curved surface protruding toward the sub-case; and a fixing portion formed to extend from an entire circumference of the curved portion and coupled to the main case.

The internal suction pipe may be formed by bending a single pipe at 90 degrees.

The internal suction pipe may be formed by coupling the connecting pipe and the stand pipe that are separately provided to each other by brazing.

The horizontal compressor may include a screen disposed on an upper portion of the stand pipe and dividing the low-pressure chamber into an upper space and a lower space.

The screen may be disposed above the suction pipe.

According to another aspect of the disclosure, a horizontal compressor may include a case; a high and low pressure separating plate formed to divide an inner space of the case into a high-pressure chamber and a low-pressure chamber; a motor disposed in the high-pressure chamber; a compressor disposed in the high-pressure chamber and driving by the motor to compress refrigerant; a suction pipe disposed in the low-pressure chamber and through which the refrigerant is suctioned; and an internal suction pipe disposed to pass through the high and low pressure separating plate, one end of the internal suction pipe connected to the compressor in the high-pressure chamber and another end of the internal suction pipe disposed in the low-pressure chamber so that the refrigerant in the low-pressure chamber flows into the compressor through the internal suction pipe, wherein the internal suction pipe may be formed in an L-shape, a first arm of the internal suction pipe connected to the compressor may be disposed to pass through the high and low pressure separating plate adjacent to a lower surface of the case in parallel to a center line of the case, and a second arm of the internal suction pipe may be disposed so that an upper end of the another arm is positioned above the suction pipe along a vertical axis of the horizontal compressor.

The internal suction pipe may include a connecting pipe passing through the high and low pressure separating plate and connected to compression part; and a stand pipe extending vertically from the connecting pipe to a lower surface of the low-pressure chamber.

DESCRIPTION OF DRAWINGS

These and/or other aspects, features, and advantages of certain embodiments of the disclosure will be more apparent from the following description taken in conjunction with the accompanying drawings, in which.

DETAILED DESCRIPTION

Figure 1:
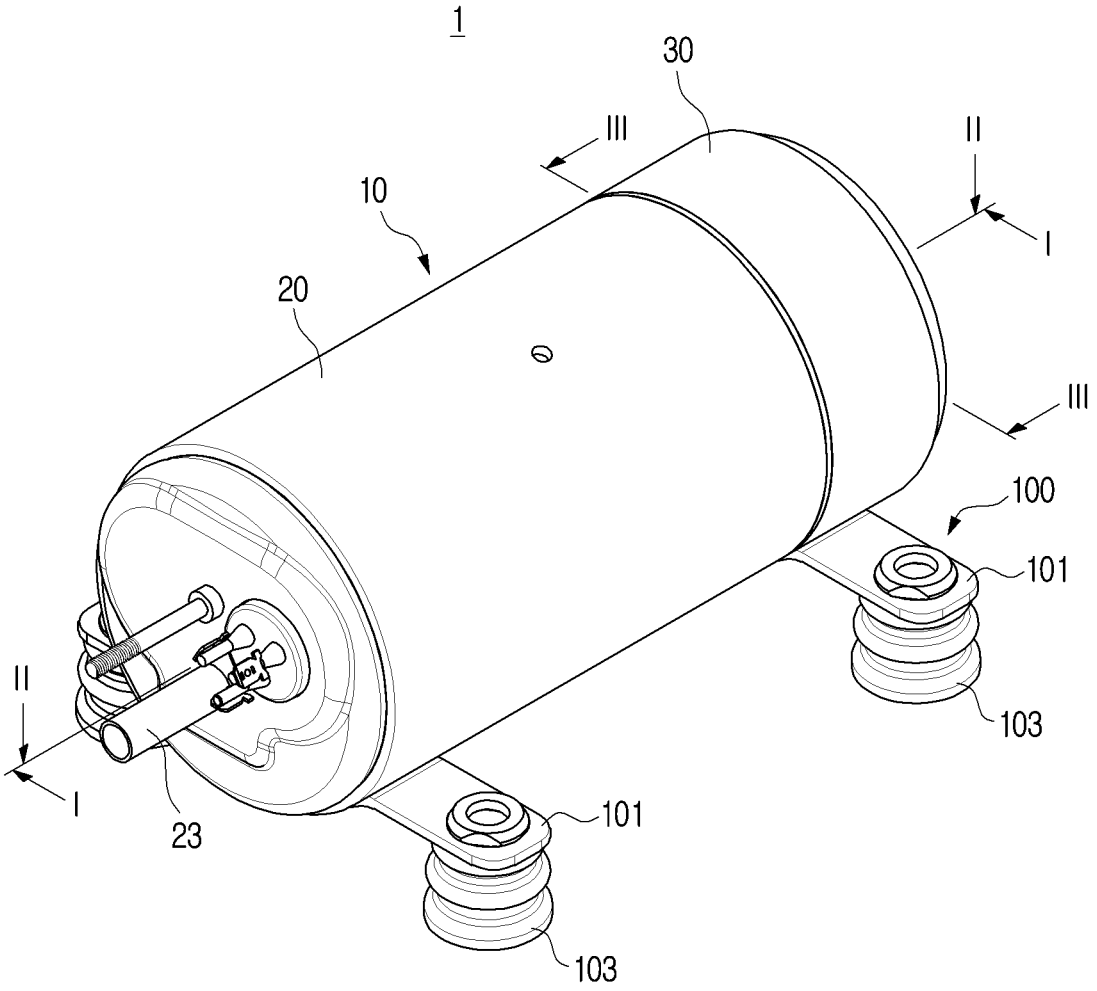
FIG. 1 is a perspective view illustrating a horizontal compressor according to an embodiment.

Various embodiments of the disclosure will hereinafter be described with reference to the accompanying drawings. However, it is to be understood that embodiments of the disclosure are not limited to the described example embodiments, and include various modifications, equivalents, and/or alternatives according to embodiments of the disclosure. The matters defined herein, such as a detailed construction and elements thereof, are provided to assist in a comprehensive understanding of the present disclosure. Thus, it is apparent that example embodiments may be carried out without those defined matters. Also, well-known functions or constructions are omitted to provide a clear and concise description of example embodiments. Further, dimensions of various elements in the accompanying drawings may be arbitrarily increased or decreased for assisting in a comprehensive understanding.

The terms 'first', 'second', etc. may be used to describe diverse components, but the components are not limited by the terms. The terms may only be used to distinguish one component from the others. For example, without departing from the scope of the disclosure, a first component may be referred to as a second component, and similarly, a second component may also be referred to as a first component.

The terms used in embodiments of the disclosure may be construed as commonly known to those skilled in the art unless otherwise defined.

Further, the terms 'leading end', 'rear end', 'upper side', 'lower side', 'top end', 'bottom end', etc. used in the disclosure are defined with reference to the drawings. However, the shape and position of each component are not limited by the terms.

An aspect of the disclosure is to provide a horizontal compressor capable of reducing an installation area compared to a conventional horizontal compressor in which an accumulator is disposed outside the horizontal compressor.

According to a horizontal compressor according to an embodiment having the above-described structure, an accumulator is provided inside the case 10, so that an installation area may be reduced compared to the conventional horizontal compressor in which the accumulator is disposed outside the case.

In addition, the horizontal compressor according to an embodiment having the above-described structure is formed so that a high-pressure chamber and a low-pressure chamber may exchange heat with each other through a high and low pressure separating plate that separates the high-pressure chamber and the low-pressure chamber. Therefore, liquid refrigerant contained in refrigerant introduced into the low-pressure chamber may be vaporized to become a gaseous refrigerant, and the temperature of oil stored in a lower portion of the high-pressure chamber is lowered, so that viscosity of the oil may be prevented from being lowered.

Hereinafter, non-limiting example embodiments of a horizontal compressor according to the disclosure will be described with reference to the accompanying drawings.

Figure 2:
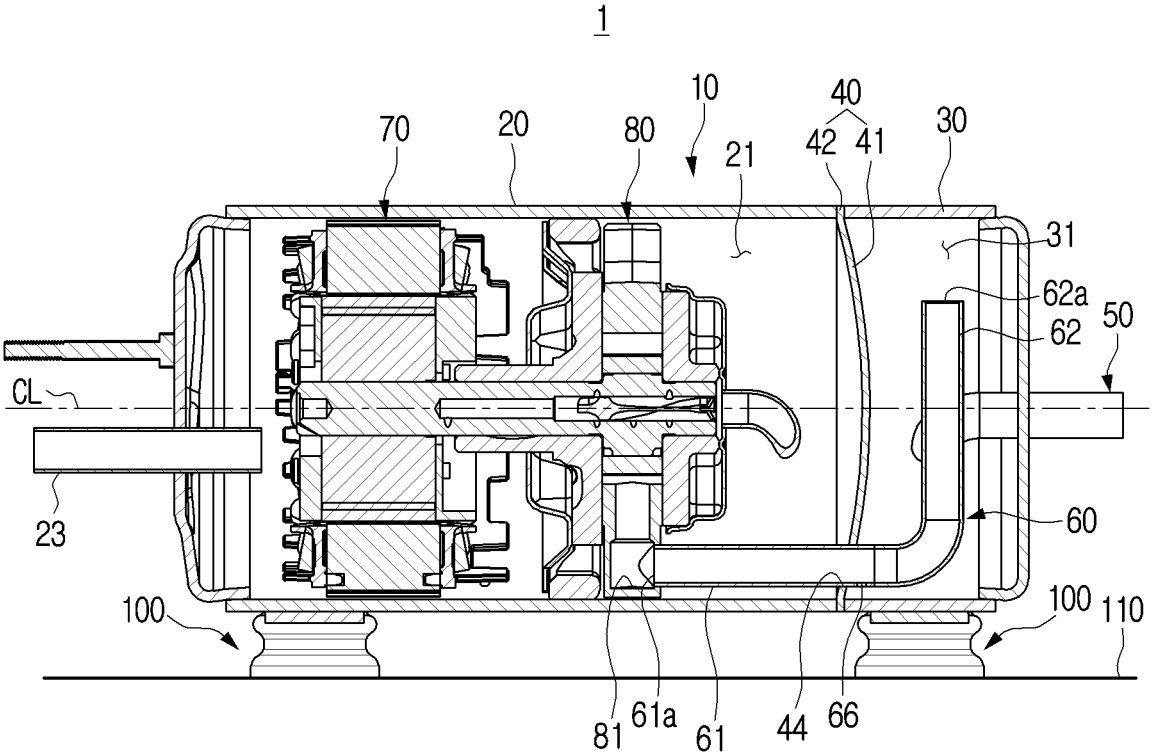
FIG. 2 is a vertical cross-sectional view illustrating the horizontal compressor of FIG. 1 taken along line I-I.
Figure 3:
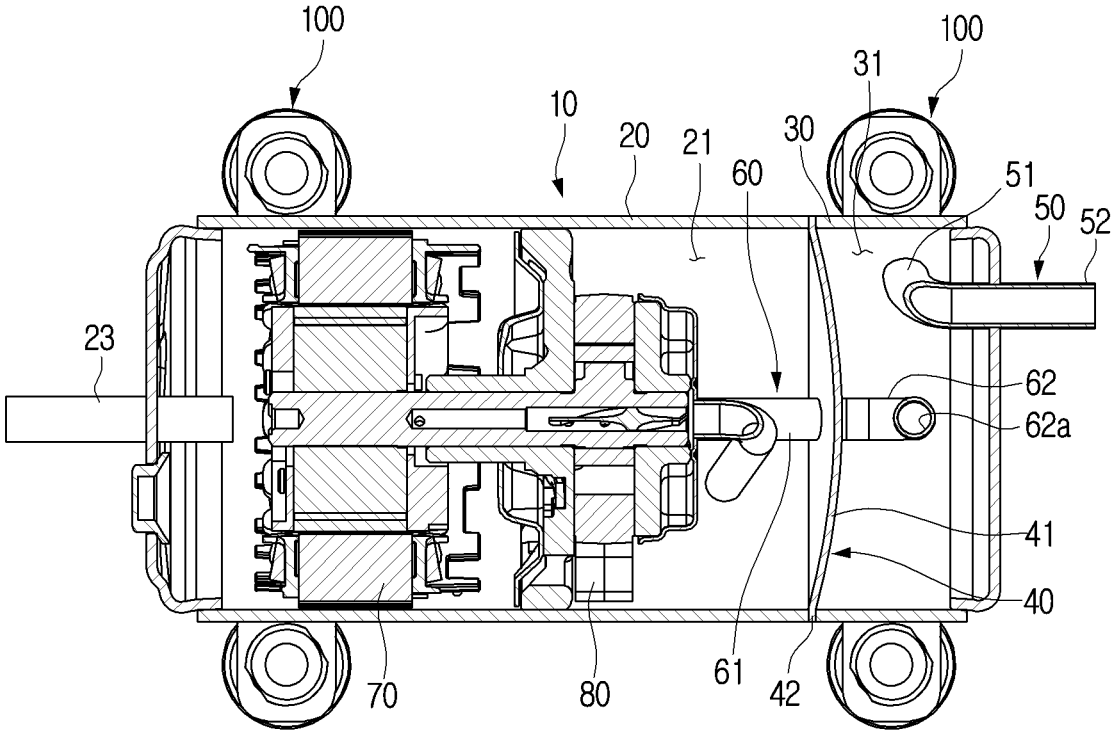
FIG. 3 is a horizontal cross-sectional view illustrating the horizontal compressor of FIG. 1 taken along line II-II.
Figure 4:
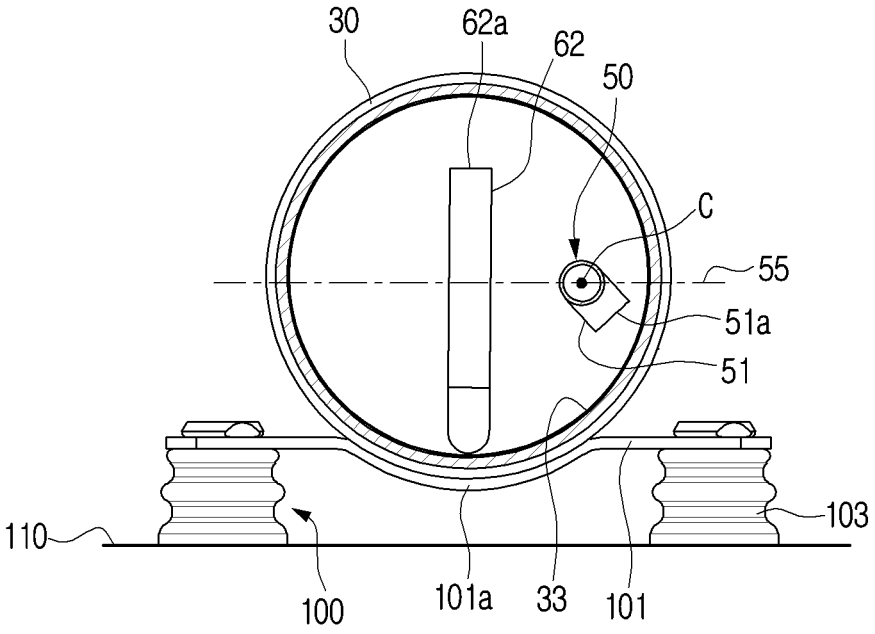
FIG. 4 is a vertical cross-sectional view illustrating the horizontal compressor of FIG. 1 taken along line III-III.

FIG. 1 is a perspective view illustrating a horizontal compressor according to an embodiment. FIG. 2 is a vertical cross-sectional view illustrating the horizontal compressor of FIG. 1 taken along line I-I. FIG. 3 is a horizontal cross-sectional view illustrating the horizontal compressor of FIG. 1 taken along line II-II. FIG. 4 is a vertical cross-sectional view illustrating the horizontal compressor of FIG. 1 taken along line III-III.

Referring to FIGS. 1 to 4, a horizontal compressor 1 according to an embodiment of the disclosure may include a case 10, a high and low pressure separating plate 40, a suction pipe 50, an internal suction pipe 60, a motor part 70 (also referred to as a motor 70), and a compression part 80 (also referred to as a compressor 80).

The case 10 forms the exterior of the horizontal compressor 1 and may include the suction pipe 50 through which refrigerant is sucked and a discharge pipe 23 through which compressed refrigerant is discharged. The case 10 may be formed in a substantially hollow cylindrical shape with both ends closed.

A refrigerant having a low pressure is introduced through the suction pipe 50, and a refrigerant having a pressure increased by being compressed by the horizontal compressor 1 is discharged through the discharge pipe 23.

As an example, as illustrated in FIG. 2, the suction pipe 50 may be disposed on the right surface of the case 10, and the discharge pipe 23 may be disposed on the left surface of the case 10.

Because the horizontal compressor 1 is disposed in the horizontal direction, the horizontal compressor 1 may be disposed so that the center line CL of the case 10, that is, the center line CL of the horizontal compressor 1 is parallel to the installation surface 110. For example, when the horizontal compressor 1 is a horizontal rotary compressor, the rotational axis of the horizontal rotary compressor corresponding to the center line CL of the case 10 may be disposed parallel to the installation surface 110.

The case 10 may be disposed to be supported by a support part 100.

The support part 100 is fixed to the installation surface 110, and may be formed to support the lower portion of the case 10.

The support part 100 may include two support brackets 101 and four support pads 103.

The support brackets 101 may be formed in a band shape with a narrow width. A concave portion 101 that is bent to a curvature corresponding to the outer circumferential surface of the case 10 may be provided in the center of the support bracket 101. The support pads 103 are disposed at both ends of each of the support brackets 101. The lower surface of the support pad 103 is formed to be flat. The lower surfaces of the four support pads 103 are positioned on the same plane. The lower surfaces of the four support pads 103 may form the lower surface of the support part 100.

Accordingly, the horizontal compressor 1 may be disposed so that the center line CL thereof is parallel to the lower surface of the support part 100.

Accordingly, the horizontal compressor 1 has a larger size in the horizontal direction than the installed height, that is, a size in the vertical direction unlike the vertical compressor.

The high and low pressure separating plate 40 may be disposed inside the case 10 to divide the inner space of the case 10 into two spaces. The inner space of the case 10 may be divided into a high-pressure chamber 21 and a low-pressure chamber 31 by the high and low pressure separating plate 40.

The high and low pressure separating plate 40 may be formed of a material having good thermal conductivity so that the high-pressure chamber 21 and the low-pressure chamber 31 can efficiently exchange heat with each other.

The compression part 80 configured to compress the refrigerant and the motor part 70 configured to operate the compression part 80 may be disposed in the high-pressure chamber 21.

The compression part 80 may be configured to operate by the motor part 70 and to compress the refrigerant. In other words, the compression part 80 may be configured to compress the refrigerant sucked from the low-pressure chamber 31 and discharge the compressed refrigerant into the high-pressure chamber 21. To this end, the compression part 80 may include an inlet 81 through which the refrigerant is introduced, an outlet through which the compressed refrigerant is discharged, and a compression mechanism configured to compress the refrigerant.

In this embodiment, the compression part 80 is formed in a rotary type. However, the structure of the compression part 80 is not limited thereto. As long as the compression part 80 is formed to compress the sucked refrigerant, various types of compression parts may be used. For example, the compression part 80 may be formed as a scroll type, a reciprocating type, or the like.

The motor part 70 may be formed to operate the compression part 80. For example, the motor part 70 may include a stator, a rotor, and a motor shaft. The motor shaft may be connected to the compression part 80 to transmit rotational force to the compression part 80.

The compression part 80 and the motor part 70 are the same as or similar to the compression part and the motor part of the conventional compressor; therefore, detailed descriptions thereof are omitted.

The high-pressure refrigerant discharged through the outlet of the compression part 80 passes through the inner space of the high-pressure chamber 21 and is discharged to the outside of the case 10 through the discharge pipe 23. The discharge pipe 23 may be disposed on one side surface of the high-pressure chamber 21 to discharge the refrigerant compressed at high pressure.

Because the high-pressure chamber 21 accommodates the refrigerant compressed and discharged by the compression part 80, the high-pressure chamber 21 maintains a high-temperature and high-pressure state compared to the low-pressure chamber 31.

Oil suppled to lubricate the compression part 80 and the motor part 70 may be stored in a lower portion of the high-pressure chamber 21. In other words, the lower portion of the high-pressure chamber 21 may form a reservoir in which oil is stored.

The low-pressure chamber 31 is provided on one side of the high-pressure chamber 21, and may form an accumulator. In detail, the low-pressure chamber 31 may be configured to separate liquid refrigerant and oil from the refrigerant sucked through the suction pipe 50 and to supply gaseous refrigerant to the compression part 80 of the high-pressure chamber 21. In other words, the low-pressure chamber 31 may be formed to function as an accumulator.

To this end, the suction pipe 50 and the internal suction pipe 60 may be provided in the low-pressure chamber 31. Then, the refrigerant flows into the low-pressure chamber 31 through the suction pipe 50, the refrigerant from which liquid refrigerant and oil are separated in the low-pressure chamber 31 becomes gaseous refrigerant, and the gaseous refrigerant is moved to the compression part 80 of the high-pressure chamber 21 through the internal suction pipe 60.

The suction pipe 50 is disposed one side surface of the low-pressure chamber 31, and may be formed so that a low-temperature, low-pressure refrigerant flows therein. One end of the suction pipe 50 may be connected to a refrigerant cycle, and the other end thereof may communicate with the internal space of the low-pressure chamber 31.

A leading end portion 51 of the suction pipe 50 protruding into the inside of the case 10 may be bent. For example, the leading end portion 51 of the suction pipe 50 positioned in the low-pressure chamber 31 may be bent such that an outlet 51*a* of the leading end portion 51 faces the inner circumferential surface 33 of the case 10.

In other words, the suction pipe 50 may be bent so that the outlet 51*a* of the suction pipe 50 faces the inner circumferential surface 33 of the cylindrical case 10 without facing the high and low pressure separating plate 40 and the right surface of the case 10. Accordingly, the outlet 51*a* of the suction pipe 50 does not face the right surface of the case 10 and the high and low pressure separating plate 40.

The suction pipe 50 may include a straight portion 52 passing through one surface of the case 10 and the leading end portion 51 bent at a predetermined angle with respect to the straight portion 52. The leading end portion 51 may be bent at an approximately right angle with respect to the straight portion 52. The suction pipe 50 may be fixed to one surface of the case 10 so that the outlet 51*a* of the leading end portion 51 faces the inner circumferential surface 33 of the case 10.

When the leading end portion 51 of the suction pipe 50 is bent so that the outlet 51*a* faces the inner circumferential surface 33 of the case 10 as described above, the refrigerant flowing in through the suction pipe 50 turns in the inner space of the low-pressure chamber 31. That is, the refrigerant flowing in through the suction pipe 50 turns along the inner circumferential surface 33 of the case 10. In other words, the refrigerant introduced through the suction pipe 50 causes a cyclonic flow in the low-pressure chamber 31.

When the refrigerant flowing into the low-pressure chamber 31 performs a cyclonic flow, the gaseous refrigerant moves upward, and the liquid refrigerant and oil move downward and are collected at the bottom of the low-pressure chamber 31. In other words, when the leading end portion 51 of the suction pipe 50 is bent so that the outlet 51*a* faces the inner circumferential surface 33 of the case 10, the liquid refrigerant and oil are effectively separated from the introduced refrigerant, so that the liquid refrigerant and oil flowing into the compression part 80 may be minimized.

Referring to FIGS. 3 and 4, the suction pipe 50 may be disposed to be biased toward one side from the center of the case 10. Then, the outlet 51*a* of the suction pipe 50 is positioned adjacent to the inner circumferential surface 33 of the case 10, so that the refrigerant discharged from the suction pipe 50 may easily turn along the inner surface of the low-pressure chamber 31.

In addition, the suction pipe 50 may be disposed so that the leading end portion 51 is inclined toward the lower portion of the inner circumferential surface 33 of the case 10. In detail, as illustrated in FIG. 4, the leading end portion 51 of the suction pipe 50 may be disposed to be inclined at a predetermined angle downward with respect to a virtual horizontal plane 55 which passes through the center C of the suction pipe 50 passing through one side surface of the case 10, for example, the right surface and is parallel to the lower surface of the support part 100, that is, the installation surface 110.

In this case, a virtual straight line passing through the center C of the straight portion 52 of the suction pipe 50 passing through the case 10 may be located on the virtual horizontal plane 55 described above. Accordingly, the outlet 51*a* of the suction pipe 50 may be positioned below the virtual horizontal plane 55 on which the center line of the straight portion 52 of the suction pipe 50 passing through the case 10 is positioned.

When the suction pipe 50 is disposed in the case 10 in this way, the refrigerant discharged from the outlet 51*a* of the leading end portion 51 of the suction pipe 50 is directed toward the lower portion of the inner circumferential surface 33 of the case 10. Therefore, the refrigerant may perform a cyclonic flow in the low-pressure chamber 31.

The internal suction pipe 60 is configured to supply the refrigerant in the low-pressure chamber 31 to the compression part 80 of the high-pressure chamber 21. The internal suction pipe 60 may be disposed approximately in the center of the low-pressure chamber 31 in the width direction.

The internal suction pipe 60 is disposed to pass through the high and low pressure separating plate 40. One end of the internal suction pipe 60 may be connected to the compression part 80, and the other end thereof may be in communication with the low-pressure chamber 31, so that the refrigerant in the low-pressure chamber 31 flows into the compression part 80 through the internal suction pipe 60. The other end of the internal suction pipe 60 is formed to be positioned at the upper portion of the low-pressure chamber 31. In other words, the internal suction pipe 60 may be formed in an approximately L-shape.

For example, the internal suction pipe 60 may include two arms 61 and 62 formed in an approximately L-shape. One arm 61 of the internal suction pipe 60 may be connected to the compression part 80 through the high and low pressure separating plate 40. In addition, one arm 61 of the internal suction pipe 60 may be disposed to penetrate the high and low pressure separating plate 40 in a state parallel to the center line CL of the case 10 and adjacent to the lower surface of the case 10.

The other arm 62 of the internal suction pipe 60 may be disposed substantially perpendicular to the lower surface of the support part 100. In addition, the internal suction pipe 60 may be disposed so that the upper end of the other arm 62 is positioned above the suction pipe 50.

The internal suction pipe 60 may include a connecting pipe 61, which is disposed to be adjacent to the lower surface of the case 10 parallel to the center line CL of the case 10 and passes through the high and low pressure separating plate 40, and a stand pipe 62 extending vertically upward from one end of the connecting pipe 61. In other words, the connecting pipe 61 may form one arm of the internal suction pipe 60 formed in an L-shape, and the stand pipe 62 may form the other arm of the internal suction pipe 60.

The connecting pipe 61 is disposed in the lower portion of the case 10 parallel to the inner circumferential surface 33 of the case 10, and one end thereof is connected to the compression part 80. One end of the compression part 80 may be press-fitted into the compression part 80.

In addition, an oil hole 66 may be provided in a portion of the connecting pipe 61 located in the low-pressure chamber 31. The oil hole 66 may be formed in a portion of the connecting pipe 61 adjacent to the inner circumferential surface 33 of the case 10. As another example, the oil hole 66 may be formed in the lower portion of the stand pipe 62 adjacent to the lower portion of the inner circumferential surface 33 of the case 10.

The oil accommodated in the lower portion of the low-pressure chamber 31 may be introduced into the connecting pipe 61 through the oil hole 66 to be supplied to the compression part 80.

The stand pipe 62 is disposed in the low-pressure chamber 31. The stand pipe 62 may be disposed perpendicular to the lower surface of the low-pressure chamber 31, that is, the installation surface 110. The stand pipe 62 may be disposed approximately in the center of the low-pressure chamber 31 in the width direction.

The stand pipe 62 extends vertically upward from one end of the connecting pipe 61 protruding into the low-pressure chamber 31 and is formed to communicate with the low-pressure chamber 31. Accordingly, an inlet 62*a* of the stand pipe 62 is positioned at the upper portion of the low-pressure chamber 31. For example, the inlet 62*a* of the stand pipe 62 may be formed to be positioned higher than the suction pipe 50. In other words, the inlet 62*a* of the stand pipe 62 may be positioned above the suction pipe 50.

The stand pipe 62 may be formed so that the inlet 62*a* of the stand pipe 62 is positioned as high as possible. When the inlet 62*a* of the stand pipe 62 is positioned at a high place, the effective volume of the low-pressure chamber 31 forming an accumulator may be increased.

The internal suction pipe 60 may be formed by bending a single pipe at about 90 degrees. In this case, one arm of the internal suction pipe 60 disposed adjacent to the inner circumferential surface 33 of the case 10 may form the connecting pipe 61, and the other arm of the internal suction pipe 60 disposed perpendicular to the inner circumferential surface 33 of the case 10 may form the stand pipe 62.

As another example, the internal suction pipe 60 may be formed by connecting the connecting pipe 61 and the stand pipe 62 which are separately formed at approximately 90 degrees. In this case, the connecting pipe 61 and the stand pipe 62 may be coupled by brazing.

Referring to FIGS. 2 and 3, the case 10 may include a main case 20, a sub-case 30, and the high and low pressure separating plate 40.

The main case 20 may be formed in a hollow cylindrical shape with one end closed, and the high and low pressure separating plate 40 may be disposed at the other open end of the main case 20. The main case 20 forms the high-pressure chamber 21 together with the high and low pressure separating plate 40.

The sub-case 30 is formed in a hollow cylindrical shape with one end closed. The other open end of the sub-case 30 may be blocked by the high and low pressure separating plate 40. The sub-case 30 forms the low-pressure chamber 31 together with the high and low pressure separating plate 40.

The high and low pressure separating plate 40 is disposed between the main case 20 and the sub-case 30. The main case 20 whose one end is blocked by the high and low pressure separating plate 40 forms the high-pressure chamber 21. In addition, the sub-case 30 whose one end is blocked by the high and low pressure separating plate 40 forms the low-pressure chamber 31.

The high and low pressure separating plate 40 may be formed in a curved plate that convexly protrudes to one side. When the high and low pressure separating plate 40 is formed as a curved plate in this way, the heat exchange area between the high-pressure chamber 21 and the low-pressure chamber 31 may be increased.

In the embodiment shown in FIGS. 2 and 3, the high and low pressure separating plate 40 is formed in a curved surface that protrudes toward the sub-case 30. As another example, although not illustrated, the high and low pressure separating plate 40 may be formed in a curved surface protruding toward the high-pressure chamber 21.

Figure 5:
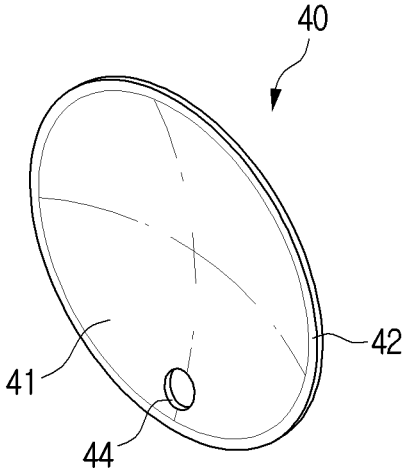
FIG. 5 is a perspective view illustrating a high and low pressure separating plate used in a horizontal compressor according to an embodiment.

FIG. 5 is a perspective view illustrating a high and low pressure separating plate to be used in a horizontal compressor according to an embodiment.

Referring to FIG. 5, the high and low pressure separating plate 40 may include a curved portion 41 and a fixing portion 42.

The curved portion 41 may be formed as a curved surface that convexly protrudes toward the sub-case 30. The circumference of the curved portion 41 may be formed in a circular shape. For example, the curved portion 41 may be formed as a part of a sphere. The curved portion 41 is provided with a through hole 44 into which the connecting pipe 61 of the internal suction pipe 60 is inserted.

The fixing portion 42 is for fixing the high and low pressure separating plate 40 to the case 10, and extends from the circumference of the curved portion 41. The fixing portion 42 is formed to be coupled to the main case 20. The fixing portion 42 may be formed in a ring shape.

The high and low pressure separating plate 40 may be coupled to the case 10 in various ways. For example, the high and low pressure separating plate 40 may be coupled between the main case 20 and the sub-case 30 by welding. When the high and low pressure separating plate 40 is coupled between the main case 20 and the sub-case 30 by welding, the refrigerant in the high-pressure chamber 21 and the low-pressure chamber 31 may not leak.

Figure 6:
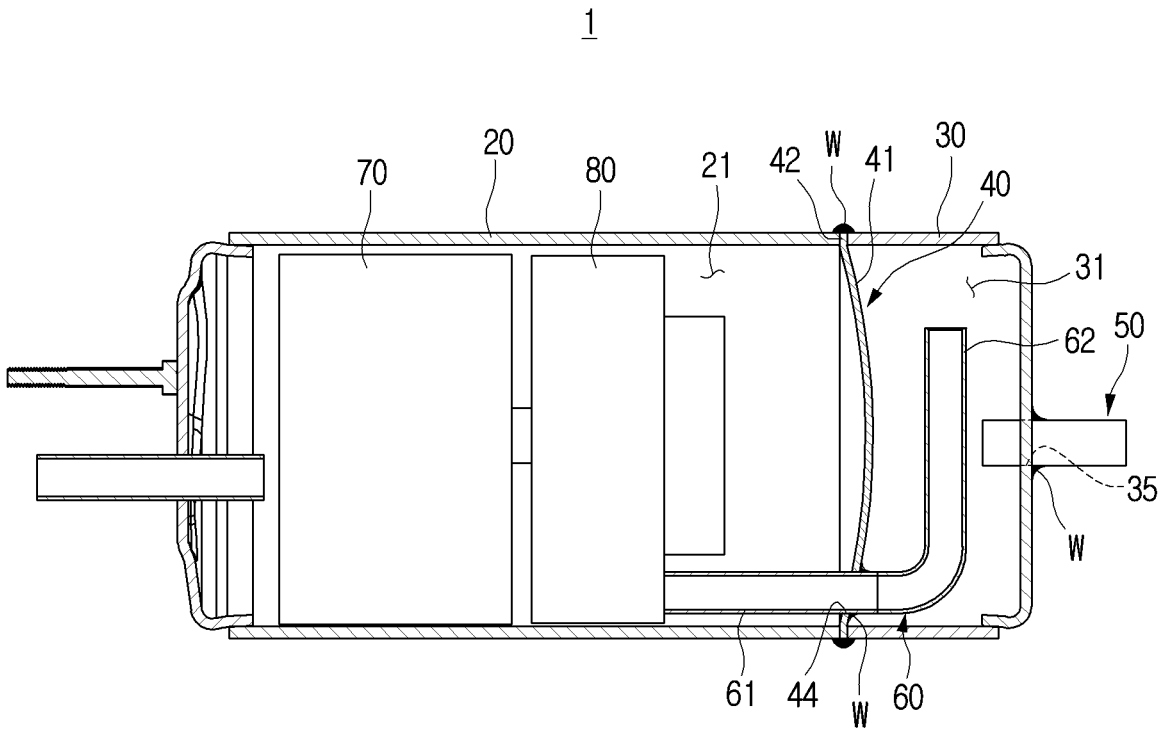
FIG. 6 is a view conceptually illustrating a horizontal compressor according to an embodiment in which a high and low pressure separating plate is fixed between a main case and a sub-case by welding.

FIG. 6 is a view conceptually illustrating a horizontal compressor according to an embodiment in which a high and low pressure separating plate is fixed between a main case and a sub-case by welding.

Referring to FIG. 6, the high and low pressure separating plate 40 is positioned between the main case 20 and the sub-case 30, and a welding bead W covering one end of the main case 20, the high and low pressure separating plate 40, and one end of the sub-case 30 is formed along the entire circumference of the circular high and low pressure separating plate 40, so that the main case 20, the high and low pressure separating plate 40, and the sub-case 30 are integrally coupled.

In this case, the outer diameter of the main case 20 may be formed to be the same as the outer diameter of the sub-case 30. The main case 20 may be formed to have the same or similar thickness to the sub-case 30.

In addition, the diameter of the high and low pressure separating plate 40 may be formed to be the same as the outer diameter of the main case 20. The width of the fixing portion 42 of the high and low pressure separating plate 40 may be formed to be wider than the thickness of the main case 20 or the sub-case 30.

Figure 7:
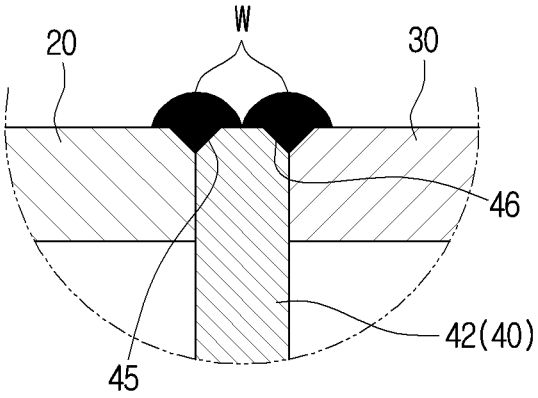
FIG. 7 is a partial cross-sectional view illustrating an example of welding connection of a high and low pressure separating plate, a main case, and a sub-case in a horizontal compressor according to an embodiment.

FIG. 7 is a partial cross-sectional view illustrating an example of welding connection of a high and low pressure separating plate, a main case, and a sub-case in a horizontal compressor according to an embodiment.

Referring to FIG. 7, a first welding groove 45 is formed in the coupling portion of the main case 20 and the high and low pressure separating plate 40, and a second welding groove 46 is formed in the sub-case 30 and the high and low pressure separating plate 40. When a welding bead W is formed in each of the first welding groove 45 and the second welding groove 46, the main case 20, the high and low pressure separating plate 40, and the sub-case 30 may be integrally coupled.

In this case, the first welding groove 45 may be formed by chamfering one end of the main case 20 and one surface of the high and low pressure separating plate 40 facing the main case 20. The second welding groove 46 may be formed by chamfering one end of the sub-case 30 and the other surface of the high and low pressure separating plate 40 facing the sub-case 30.

When the main case 20, the high and low pressure separating plate 40, and the sub-case 30 are welded using the welding grooves 45 and 46 as illustrated in FIG. 7, leakage of the refrigerant between the main case 20 and the high and low pressure separating plate 40 and between the sub-case 30 and the high and low pressure separating plate 40 may be effectively prevented.

Figure 8:
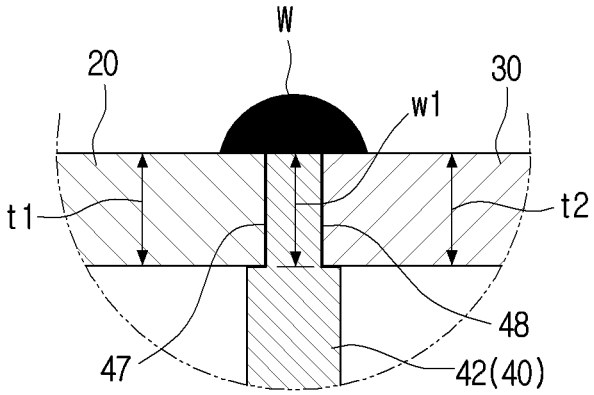
FIG. 8 is a partial cross-sectional view illustrating an example of welding connection of a high and low pressure separating plate, a main case, and a sub-case in a horizontal compressor according to an embodiment.

FIG. 8 is a partial cross-sectional view illustrating an example of welding connection of a high and low pressure separating plate, a main case, and a sub-case in a horizontal compressor according to an embodiment.

Referring to FIG. 8, at the edge of the high and low pressure separating plate 40, coupling steps 47 and 48 in which the main case 20 and the sub-case 30 are disposed may be formed. In detail, a first coupling step 47 may be formed on one surface of the fixing portion 42 of the high and low pressure separating plate 40 facing the main case 20, and a second coupling step 48 may be formed on the other surface of the fixing portion 42 of the high and low pressure separating plate 40 facing the sub-case 30.

The size of each of the coupling steps 47 and 48 may be formed to correspond to the thickness of each of the main case 20 and the sub-case 30.

For example, the first coupling step 47 forms a step with one surface of the fixing portion 42 of the high and low pressure separating plate 40 on which the main case 20 is disposed, and the width w1 of the first coupling step 47 may be formed to have the same size as the thickness of the main case 20. The second coupling step 48 forms a step with the other surface of the fixing portion 42 of the high and low pressure separating plate 40 on which the sub-case 30 is disposed, and the width w1 of the second coupling step 48 may be formed to have the same size as the thickness of the sub-case 30. The diameter of the high and low pressure separating plate 40 may be the same as the outer diameter of the main case 20 and the outer diameter of the sub-case 30.

One end of the main case 20 is disposed at the first coupling step 47 of the high and low pressure separating plate 40, and one end of the sub-case 30 is disposed at the second coupling step 48 of the high and low pressure separating plate 40. A welding bead W covering one end of the main case 20, the high and low pressure separating plate 40, and one end of the sub-case 30 is formed along the entire circumference of the circular high and low pressure separating plate 40, so that the main case 20, the high and low pressure separating plate 40, and the sub-case 30 are integrally coupled.

When the main case 20, the high and low pressure separating plate 40, and the sub-case 30 are welded using the coupling steps 47 and 48 as illustrated in FIG. 8, the refrigerant may be effectively prevented from leaking between the main case 20 and the high and low pressure separating plate 40 and between the sub-case 30 and the high and low pressure separating plate 40.

On the other hand, referring to FIG. 6, the internal suction pipe 60 may be fixed to the high and low pressure separating plate 40 by welding while being inserted into the through hole 44 of the high and low pressure separating plate 40.

In addition, the suction pipe 50 may be fixed to the sub-case 30 by welding while being inserted into the through hole 35 provided on one side surface of the sub-case 30.

Figure 9:
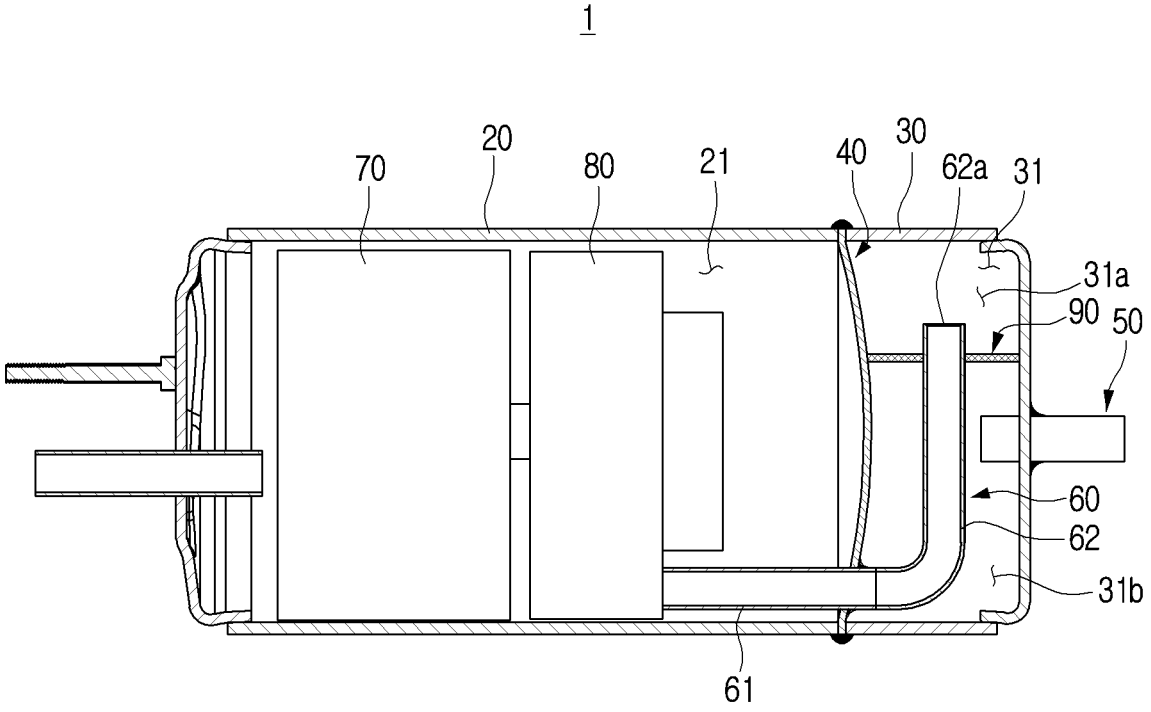
FIG. 9 is a vertical cross-sectional view conceptually illustrating a horizontal compressor according to another embodiment.

In the low-pressure chamber 31 of the horizontal compressor 1 according to an embodiment, as illustrated in FIG. 9, a screen 90 capable of filtering the refrigerant sucked through the suction pipe 50 may be disposed.

FIG. 9 is a vertical cross-sectional view conceptually illustrating a horizontal compressor according to another embodiment.

Referring to FIG. 9, a screen 90 may be disposed in the low-pressure chamber 31. The screen 90 may be fixed to the stand pipe 62. The screen 90 may be disposed at the upper portion of the stand pipe 62. In addition, the screen 90 may be disposed at the upper portion of the stand pipe 62 above the suction pipe 50. The screen 90 may be fixed to the stand pipe 62 by welding.

The screen 90 is formed to separate liquid refrigerant and foreign substances from the refrigerant introduced into the low-pressure chamber 31 through the suction pipe 50.

The screen 90 disposed in the low-pressure chamber 31 may divide the low-pressure chamber 31 into an upper space 31*a* and a lower space 31*b*. Accordingly, the refrigerant discharged from the suction pipe 50 flows into the lower space 31*b* of the low-pressure chamber 31. The gaseous refrigerant passing through the screen 90 flows into the upper space 31*a* of the low-pressure chamber 31, and enters the inlet 62*a* of the stand pipe 62.

The screen 90 may be formed of a mesh. For example, the screen 90 may be formed of a wire of 100×100 mesh, 0.1 mm in diameter.

Accordingly, the gaseous refrigerant among the refrigerant introduced into the low-pressure chamber 31 through the suction pipe 50 passes through the screen 90, moves to the upper side of the screen 90, that is, to the upper space 31*a* of the low-pressure chamber 31, and enters the inlet 62*a* of the stand pipe 62.

The liquid refrigerant among the refrigerant introduced into the low-pressure chamber 31 does not pass through the screen 90 and is collected in the lower portion of the low-pressure chamber 31. In addition, oil and foreign substances contained in the introduced refrigerant do not pass through the screen 90, and are collected in the lower portion of the low-pressure chamber 31.

In the above-described embodiment, the high and low pressure separating plate 40 is formed in a curved plate; however, the shape of the high and low pressure separating plate 40 is not limited thereto. A high and low pressure separating plate 40 having a different shape will be described with reference to FIG. 10.

Figure 10:
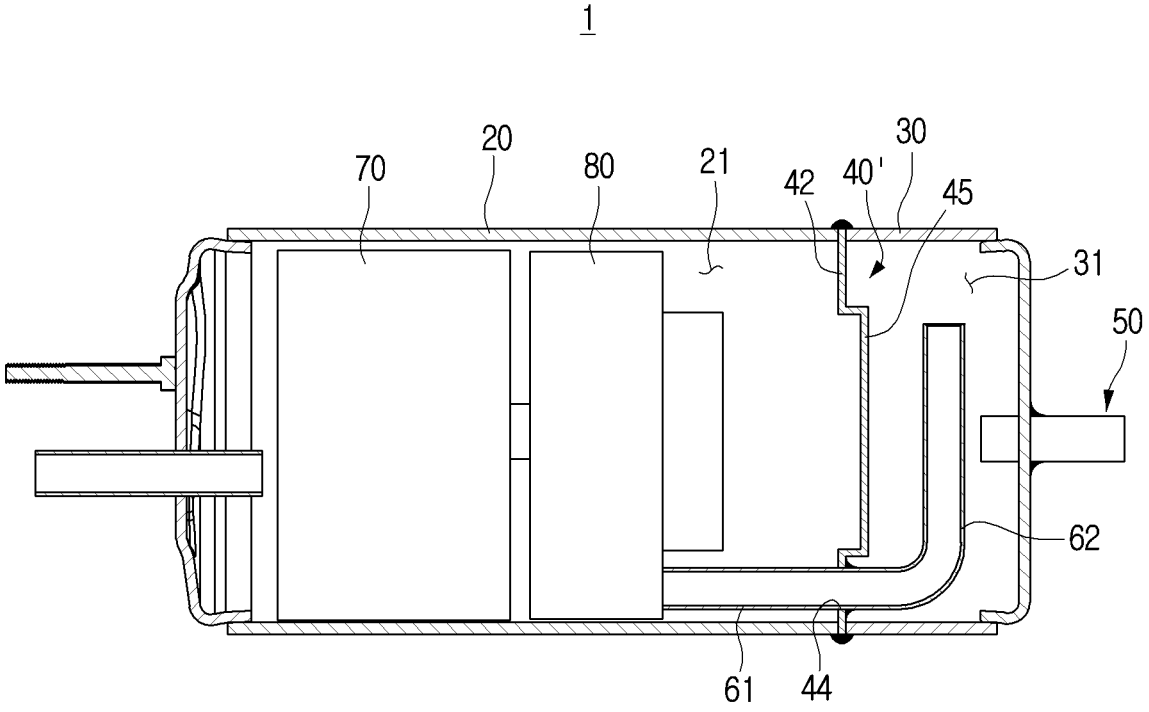
FIG. 10 is a vertical cross-sectional view conceptually illustrating a horizontal compressor according to another embodiment.

FIG. 10 is a vertical cross-sectional view conceptually illustrating a horizontal compressor according to another embodiment.

Referring to FIG. 10, a horizontal compressor 1 according to an embodiment of the disclosure may include a main case 20, a sub-case 30, a high and low pressure separating plate 40', a suction pipe 50, an internal suction pipe 60, a motor part 70, and a compression part 80.

The main case 20, the sub-case 30, the suction pipe 50, the internal suction pipe 60, the motor part 70, and the compression part 80 are the same as or similar to those of the above-described embodiment, so detailed descriptions thereof are omitted.

The high and low pressure separating plate 40' forms the case 10 together with the main case 20 and the sub-case 30, and may divide the inside of the case 10 into a high-pressure chamber 21 and a low-pressure chamber 31.

The high and low pressure separating plate 40' is disposed between the main case 20 and the sub-case 30. The main case 20 whose one end is closed by the high and low pressure separating plate 40' forms the high-pressure chamber 21. In addition, the sub-case 30 whose one end is closed by the high and low pressure separating plate 40' forms the low-pressure chamber 31.

The high and low pressure separating plate 40' may include a circular protrusion 45 protruding into the low-pressure chamber 31. When the high and low pressure separating plate 40' is formed as a plate having the circular protrusion 45 as described above, the heat exchange area between the high-pressure chamber 21 and the low-pressure chamber 31 may be increased.

The high and low pressure separating plate 40' may include the circular protrusion 45 and a fixing portion 42.

The circular protrusion 45 may be formed as a protrusion having a circular cross-section convexly protruding toward the sub-case 30. The inside of the circular protrusion 45 is hollow. Accordingly, a groove having a circular cross-section is formed in one surface of the high and low pressure separating plate 40' facing the high-pressure chamber 21, and a protrusion having a circular cross-section is formed on the other surface of the high and low pressure separating plate 40' facing the low-pressure chamber 31.

The fixing portion 42 is for fixing the circular protrusion 45 to the case 10, and extends from the circumference of the circular protrusion 45. The fixing portion 42 is formed to be coupled to the main. The fixing portion 42 may be formed in a ring shape.

The fixing portion 42 may be provided with a through hole 44 into which the connecting pipe 61 of the internal suction pipe 60 is inserted.

The outer diameter of the circular protrusion 45 is formed smaller than the inner diameter of the sub-case 30. The diameter of the fixing portion 42 is formed to be the same as the outer diameter of the main case 20 and the outer diameter of the sub-case 30.

The fixing portion 42 of the high and low pressure separating plate 40' may be coupled to the case in various ways. For example, the fixing portion 42 of the high and low pressure separating plate 40' may be coupled between the main case 20 and the sub-case 30 by welding. When the fixing portion 42 of the high and low pressure separating plate 40' is coupled between the main case 20 and the sub-case 30 by welding, the refrigerant in the high-pressure chamber 21 and the low-pressure chamber 31 may not leak between the main case 20 and the high and low pressure separating plate 40' and between the sub-case 30 and the high and low pressure separating plate 40'.

In the above description, the high and low pressure separating plate 40' has a shape protruding toward the low-pressure chamber 31; however, the structure of the high and low pressure separating plate 40' is not limited thereto. The high and low pressure separating plate may be formed in a disk shape as illustrated in FIG. 11.

Figure 11:
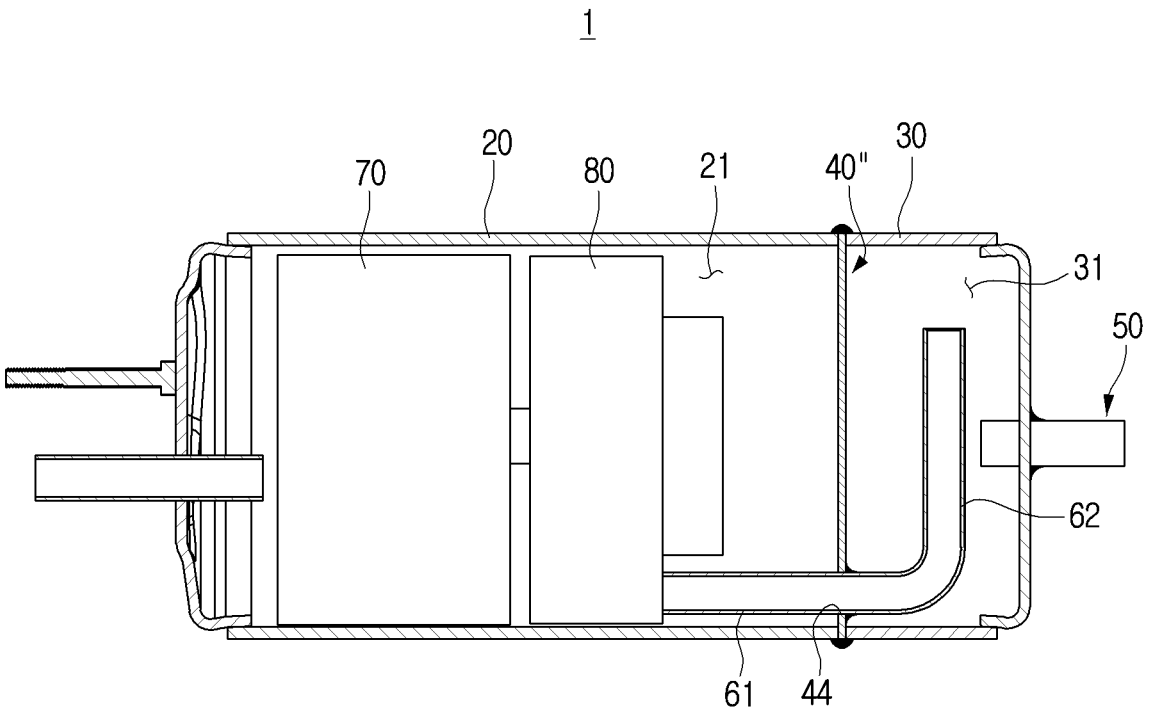
FIG. 11 is a vertical cross-sectional view conceptually illustrating a horizontal compressor according to another embodiment.

FIG. 11 is a vertical cross-sectional view conceptually illustrating a horizontal compressor according to another embodiment.

Referring to FIG. 11, a horizontal compressor 1 according to an embodiment of the disclosure may include a main case 20, a sub-case 30, a high and low pressure separating plate 40", a suction pipe 50, an internal suction pipe 60, a motor part 70, and a compression part 80.

The main case 20, the sub-case 30, the suction pipe 50, the internal suction pipe 60, the motor part 70, and the compression part 80 are the same as or similar to those of the above-described embodiment, so detailed descriptions thereof are omitted.

The high and low pressure separating plate 40" forms the case 10 together with the main case 20 and the sub-case 30, and may divide the inside of the case 10 into a high-pressure chamber 21 and a low-pressure chamber 31.

The high and low pressure separating plate 40" is disposed between the main case 20 and the sub-case 30. The main case 20 whose one end is closed by the high and low pressure separating plate 40" forms the high-pressure chamber 21. In addition, the sub-case 30 whose one end is closed by the high and low pressure separating plate 40" forms the low-pressure chamber 31.

The high and low pressure separating plate 40" may be formed in a disk shape. The disk-shaped high and low pressure separating plate 40" may be fixed to one end of the main case 20 and one end of the sub-case 30 by welding.

Hereinafter, an assembling method of a horizontal compressor 1 according to an embodiment will be described with reference to FIGS. 2 and 12.

Figure 12:
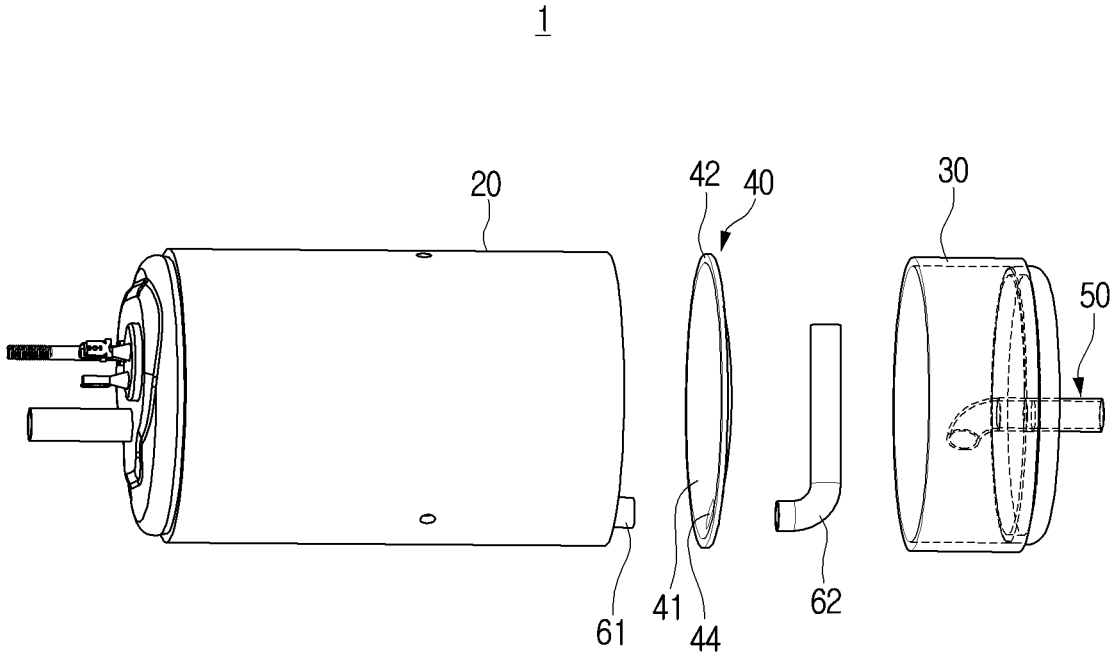
FIG. 12 is an exploded perspective view illustrating a horizontal compressor according to an embodiment.

FIG. 12 is an exploded perspective view illustrating a horizontal compressor according to an embodiment.

The connecting pipe 61 is disposed in the compression part 80 provided in the main case 20. The connecting pipe 61 may be coupled to the compression part 80 by press-fitting into the inlet 81 of the compression part 80.

The connecting pipe 61 is inserted into the through hole 44 of the high and low pressure separating plate 40, and the fixing portion 42 of the high and low pressure separating plate 40 is brought into close contact with one end of the main case 20. At this time, the curved portion 41 of the high and low pressure separating plate 40 is made to protrude toward the outside. In this state, the connecting pipe 61 is coupled to the high and low pressure separating plate 40 by welding.

Next, one end of the stand pipe 62 is coupled to one end of the connecting pipe 61 protruding from the high and low pressure separating plate 40. The stand pipe 62 is formed in a substantially L-shape. Accordingly, one arm with a short length of the stand pipe 62 is connected to one end of the connecting pipe 61 protruding through the high and low pressure separating plate 40. In this case, the connecting pipe 61 and the stand pipe 62 may be coupled by brazing.

In another process, the suction pipe 50 may be coupled to the sub-case 30. In other words, when the suction pipe 50 is inserted into the through hole 35 of the sub-case 30 and the entire circumference of the suction pipe 50 is joined to the side surface of the sub-case 30 by welding, the suction pipe 50 may be integrally coupled to the sub-case 30. In this case, the suction pipe 50 is fixed to the sub-case 30 such that the outlet 51*a* of the leading end portion 51 of the suction pipe 50 faces the inner circumferential surface 33 of the sub-case 30.

As described above, because the suction pipe 50 is coupled to the sub-case 30 by welding, the refrigerant may be prevented from leaking between the suction pipe 50 and the through hole 35 of the sub-case 30.

Finally, the sub-case 30 is disposed to cover the high and low pressure separating plate 40 and the stand pipe 62. In detail, the sub-case 30 is disposed so that one end of the sub-case 30 is in contact with one surface of the fixing portion 42 of the high and low pressure separating plate 40, and the main case 20, the high and low pressure separating plate 40, and the sub-case 30 are coupled to each other by welding. In other words, when the welding bead W is formed along the entire circumference of the high and low pressure separating plate 40, the main case 20, the high and low pressure separating plate 40, and the sub-case 30 are integrally coupled.

At this time, because the suction pipe 50 is coupled to the sub-case 30, when the sub-case 30 is coupled to the high and low pressure separating plate 40, the manufacture of the horizontal compressor 1 is completed.

Hereinafter, the operation of the horizontal compressor 1 according to an embodiment will be described in detail with reference to FIG. 13.

Figure 13:
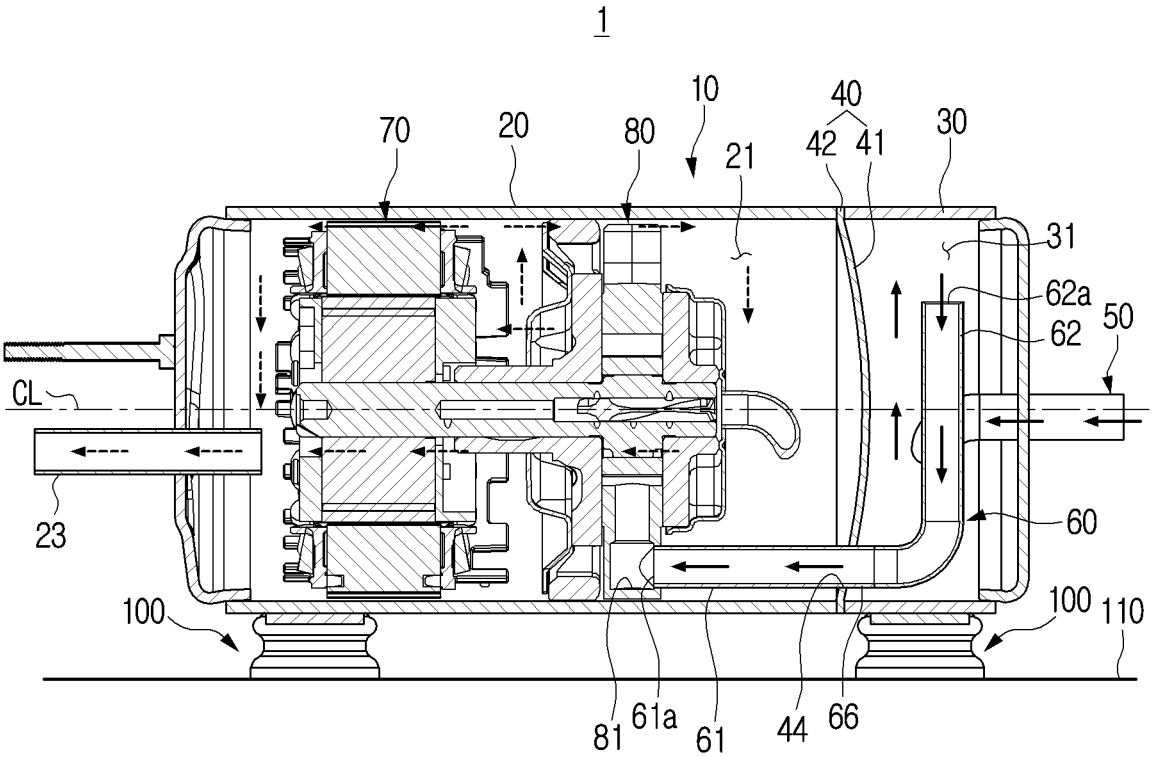
FIG. 13 is a vertical cross-sectional view for explaining the operation of a horizontal compressor according to an embodiment.

FIG. 13 is a vertical cross-sectional view for explaining the operation of a horizontal compressor according to an embodiment.

Although not illustrated, the suction pipe 50 and the discharge pipe 23 of the horizontal compressor 1 may be connected to a refrigerant cycle. For example, the suction pipe 50 may be connected to the evaporator of the refrigerant cycle, and the discharge pipe 23 may be connected to the condenser.

A low-temperature, low-pressure refrigerant may be introduced into the suction pipe 50. The leading end portion 51 of the suction pipe 50 is disposed to face the inner wall of the low-pressure chamber 31, that is, inner circumferential surface 33 of the sub-case 30, so that the refrigerant flowing into through the suction pipe 50 turns in the inside of the low-pressure chamber 31. In other words, the refrigerant introduced through the suction pipe 50 causes a cyclonic flow in the low-pressure chamber 31.

When the refrigerant performs the cyclonic flow in the low-pressure chamber 31 as described above, the introduced refrigerant may be effectively separated into gaseous refrigerant, liquid refrigerant, and oil.

The separated refrigerant in the gaseous state move to the upper portion of the low-pressure chamber 31 and flows into the inlet 62*a* of the stand pipe 62. The refrigerant introduced into the inlet 62*a* of the stand pipe 62 flows into the compression part 80 through the connecting pipe 61.

The refrigerant introduced into the compression part 80 is compressed by the compression part 80, and then discharged to the outside of the compression part 80 through the outlet of the compression part 80. The outlet of the compression part 80 is located inside the high-pressure chamber 21, so that the refrigerant compressed in the compression part 80 is discharged into the high-pressure chamber 21. In this case, the compression part 80 may be operated by the motor part 70 to compress the refrigerant and discharge the compressed refrigerant to the high-pressure chamber 21.

The refrigerant compressed in the compression part 80 is high-temperature and high pressure, so that the inside of the high-pressure chamber 21 is in a high-temperature and high-pressure state.

In this case, the high-pressure chamber 21 and the low-pressure chamber 31 are in contact with each other through the high and low pressure separating plate 40, so that the high-pressure chamber 21 and the low-pressure chamber 31 may exchange heat with each other. Accordingly, because the temperature of the low-pressure chamber 31 is increased by the high-pressure chamber 21, the liquid refrigerant in the low-pressure chamber 31 may easily change phase into the gaseous refrigerant. Thus, the amount of liquid refrigerant in the refrigerant sucked into the low-pressure chamber 31 may be reduced.

In addition, because the temperature of the high-pressure chamber 21 is lowered under the influence of the low-pressure chamber 31, it is possible to limit the decrease in the viscosity of the oil stored in the lower portion of the high-pressure chamber 21. In detail, compared to the viscosity of the oil stored inside the case of the horizontal compressor in which the low-pressure chamber 31 serving as an accumulator is not provided inside the case 10, when the low-pressure chamber 31 serving as an accumulator is provided inside the case 10 like the horizontal compressor 1 according to an embodiment, the viscosity of the oil stored in the case 10 may be increased.

The refrigerant discharged into the high-pressure chamber 21 passes through the motor part 70, and then is discharged to the outside of the high-pressure chamber 21 through the discharge pipe 23 provided at one side surface of the high-pressure chamber 21. When the discharge pipe 23 is connected to the condenser, the refrigerant discharged through the discharge pipe 23 may move to the condenser through a pipe connecting the discharge pipe 23 and the condenser.

In the horizontal compressor 1 according to an embodiment having the above-described structure, because the accumulator is provided inside the case 10, the installation area (footprint) of the horizontal compressor 1 may be reduced compared to the conventional horizontal compressor in which the accumulator is disposed outside the case.

In addition, the horizontal compressor 1 according to an embodiment having the above-described structure is formed so that the high-pressure chamber 21 and the low-pressure chamber 31 may exchange heat with each other through the high and low pressure separating plate 40 that separates the high-pressure chamber 21 and the low-pressure chamber 31. Therefore, the liquid refrigerant contained in the refrigerant introduced into the low-pressure chamber 31 may be vaporized to become gaseous refrigerant. The temperature of the oil stored in the lower portion of the high-pressure chamber 21 is lowered, so that the viscosity of the oil may be prevented from being lowered.

In addition, the horizontal compressor 1 according to an embodiment having the above-described structure is provided with the high and low pressure separating plate 40 and the low-pressure chamber 31 functioning as an accumulator between the compression part 80 and one side surface of the case 10. Therefore, noise radiated in the horizontal direction to one side of the compression part 80 may be reduced. In detail, because the high and low pressure separating plate 40 and the space forming the low-pressure chamber 31 serve as a noise blocking member that blocks noise generated by the compression part 80, radiation noise in the horizontal direction radiated in one direction of the horizontal compressor 1 may be reduced.

The disclosure has been described above in an exemplary manner. The terms used herein are for the purpose of description and should not be construed in a limiting sense. Various modifications and variations of the disclosure are possible according to the above contents. Accordingly, unless otherwise stated, the disclosure may be practiced freely within the scope of the claims.

What is claimed is:

1. A horizontal compressor comprising:

a case having an inner space;

a high and low pressure separating plate dividing the inner space into a high-pressure chamber and a low-pressure chamber;

a motor in the high-pressure chamber;

a compressor in the high-pressure chamber and driven by the motor to compress refrigerant;

a suction pipe passing through the case into the low-pressure chamber and through which the refrigerant is suctioned, the suction pipe including a leading end portion having an outlet, and the leading end portion is bent and the outlet is angled downward relative to a virtual horizontal plane that passes through a center of the suction pipe where the suction pipe passes through the case so that the outlet is below the virtual horizontal plane and faces a lower portion of an inner circumferential surface of the case, and the suctioned refrigerant discharged from the outlet is directed toward the lower portion so as to turn along the inner circumferential surface and causes a cyclonic flow in the low-pressure chamber; and an internal suction pipe passing through the high and low pressure separating plate so that the refrigerant in the low-pressure chamber flows into the compressor through the internal suction pipe, the internal suction pipe including:

a connecting pipe passing through the high and low pressure separating plate, adjacent to a lower surface of the case, parallel to a central axis of the case, and having a first end connected to the compressor in the high-pressure chamber, and a stand pipe in the low-pressure chamber, extended from a second end of the connecting pipe upward along a vertical axis of the horizontal compressor, and including an inlet that is positioned higher than the suction pipe along the vertical axis.

2. The horizontal compressor of claim 1, wherein the internal suction pipe has an opening adjacent to a lower portion of the low-pressure chamber that forms an oil hole.

3. The horizontal compressor of claim 1, wherein the leading end portion of the suction pipe is inclined toward a lower portion of the inner circumferential surface.

4. The horizontal compressor of claim 1, wherein the outlet of the suction pipe is below a virtual straight line passing through a center of a straight portion of the suction pipe that passes through the case.

5. The horizontal compressor of claim 1, wherein the high and low pressure separating plate includes a curved plate convexly protruding to one side.

6. The horizontal compressor of claim 1, wherein
the case includes:
a main case forming the high-pressure chamber, and
a sub-case forming the low-pressure chamber, and
the high and low pressure separating plate is between the main case and the sub-case.

7. The horizontal compressor of claim 6, wherein the main case, the sub-case, and the high and low pressure separating plate are welded together.

8. The horizontal compressor of claim 6, wherein the high and low pressure separating plate protrudes toward the sub-case.

9. The horizontal compressor of claim 8, wherein
the high and low pressure separating plate includes:
a curved portion having a curved surface that protrudes toward the sub-case; and
a fixing portion that extends from an entire circumference of the curved portion and is coupled to the main case.

10. The horizontal compressor of claim 1, wherein the internal suction pipe includes a single pipe that is bent at 90 degrees.

11. The horizontal compressor of claim 1, wherein the connecting pipe and the stand pipe are brazed together to form the internal suction pipe.

12. The horizontal compressor of claim 1, further comprising:
a screen on an upper portion of the stand pipe and dividing the low-pressure chamber into an upper space and a lower space.

13. The horizontal compressor of claim 12, wherein the screen is above the suction pipe.

14. The horizontal compressor of claim 1, wherein the suction pipe further includes a straight portion and the leading end portion includes a right-angle bend relative to the straight portion.

15. A horizontal compressor comprising:
a case having an inner space;
a high and low pressure separating plate dividing the inner space into a high-pressure chamber and a low-pressure chamber;
a motor in the high-pressure chamber;
a compressor in the high-pressure chamber and driven by the motor to compress refrigerant;
a suction pipe passing through the case into the low-pressure chamber and through which the refrigerant is suctioned, the suction pipe including a leading end portion having an outlet, and the leading end portion is bent and the outlet is angled downward relative to a virtual horizontal plane that passes through a center of the suction pipe where the suction pipe passes through the case so that the outlet is below the virtual horizontal plane and faces a lower portion of an inner circumferential surface of the case, and the suctioned refrigerant discharged from the outlet is directed toward the lower portion so as to turn along the inner circumferential surface and causes a cyclonic flow in the low-pressure chamber; and
an internal suction pipe passing through the high and low pressure separating plate so that the refrigerant in the low-pressure chamber flows into the compressor through the internal suction pipe, the internal suction pipe being formed in an L-shape and including:
a first arm passing through the high and low pressure separating plate, adjacent to a lower surface of the case, parallel to a center line of the case, and having a first end connected to the compressor in the high-pressure chamber, and
a second arm in the low-pressure chamber, extending from a second end of the first arm, and having an end positioned above the suction pipe along a vertical axis of the horizontal compressor.

* * * * *